US005761932A

United States Patent [19]

Kim

[11] Patent Number: 5,761,932

[45] Date of Patent: Jun. 9, 1998

[54] DYNAMIC BALANCING APPARATUS FOR CLOTHES-WASHER

[75] Inventor: Do Weon Kim, Seoul, Rep. of Korea

[73] Assignee: Samsung Electronics Co., Ltd., Suwon, Rep. of Korea

[21] Appl. No.: 703,964

[22] Filed: Aug. 28, 1996

[30] Foreign Application Priority Data

Aug. 28, 1995 [KR] Rep. of Korea ..... 95-26948

[51] Int. Cl.[6] ..... D06F 37/24

[52] U.S. Cl. ..... 68/23.2; 74/573 F

[58] Field of Search ..... 68/23.2; 210/144, 210/363, 364; 74/573 F, 573 R

[56] References Cited

U.S. PATENT DOCUMENTS 5,460,017 10/1995 Taylor ..... 74/573 R X

FOREIGN PATENT DOCUMENTS 206486 9/1986 Japan ..... 68/23.2

299297 12/1987 Japan ..... 68/23.2

2104553 3/1983 United Kingdom ..... 68/23.2

*Primary Examiner*—Philip R. Coe

*Attorney, Agent, or Firm*—Burns, Doane, Swecker & Mathis, L.L.P.

[57] ABSTRACT

A balancing member of a washing machine is mounted on a spin basket which is rotatable around a vertical axis. The balancing member comprises a lower member and an upper member covering the lower member, the members forming a plurality of coaxial passages containing a balancing medium such as a liquid or balls entrained in a liquid.

5 Claims, 6 Drawing Sheets

DYNAMIC BALANCING APPARATUS FOR CLOTHES-WASHER

BACKGROUND OF THE INVENTION

The invention relates to a balancing member for a clothes washing machine.

PRIOR ART

FIG. 6 illustrates a clothes washing machine with a conventional balancing member. A balancing member 6 is coaxially attached to a circumference of an opening 3A of an inner tub 3 rotating around a vertical shaft S—S. The balancing member 6 is comprised of a single circular passage 6A. In the passage 6A, a liquid—for instance, a salt solution—is housed. The inner tub 3, housed in an outer tub 2, is rotated with a pulsator 4 by the operation of a driving member 5. As a result of the high speed spinning of the inner tub 3, laundry L leans to a certain area. To offset this imbalance a liquid 6B of the balancing member 6 is moved into the opposite area of laundry L.

The balancing member 6 is manufactured as follows: the upper member 6U and the lower member 6L are put together, and their bordering line is fused by a proper method to become an integral member; next, liquid 6B is inserted into the passage 6A through a small hole (not shown). The installation of the balancing member 6 within the tube 3 results in a complication. Because the balancing member is attached to the circumference of the opening 3A of the inner tub 3 by a fusion method, distortion is possible in the contact area between the inner tub and the balancing member. Moreover, owing to the fusion assembly for joining the upper member and the lower member, a minute crack might occur in any one of the contact areas. Therefore, the liquid seal cannot be guaranteed. This results in the problem that components of the washing machine become corroded, or, laundry is damaged by the leaked liquid (e.g. salt solution).

SUMMARY OF THE INVENTION

Accordingly, the purpose of the invention is to provide a balancing member for a clothes washing machine that has an upper member and a lower member joined in a sealed manner, thereby assuring liquid-tightness of the balancing member.

In order to accomplish this purpose, the balancing member of a cloths washing machine should comprise the following: a housing; an outer tub suspended in the housing; an inner tub movably mounted about a vertical axis in the housing; and a balancing member mounted on the inner tub and arranged coaxially to the inner tub. The balancing member comprises a lower member and an upper member solidly covering the lower member; further the balancing member has a plurality of annular passages.

The distance between an inside circumference and an outer circumference of the lower member is slightly larger than that between walls of the upper member which are to engage the inside and outside circumferences of the lower member, thereby creating a tight fit therebetween.

The upper member covers the lower member in an elastic manner.

BRIEF DESCRIPTION OF THE DRAWINGS

The invention will now be described in detail with reference to the accompanying drawings, in which.

DETAILED DESCRIPTION OF THE PREFERRED EMBODIMENTS OR INVENTION

Figure 1:
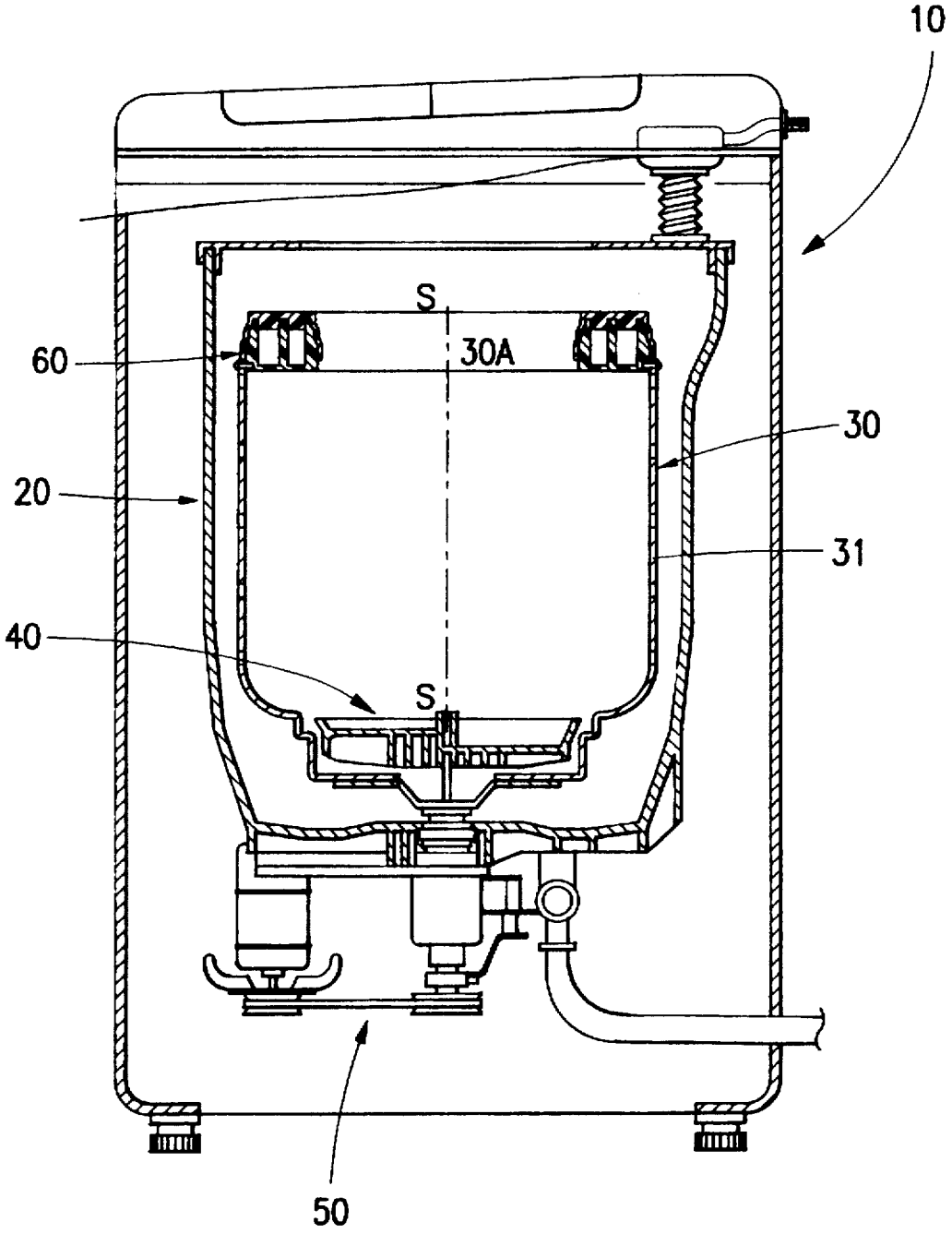
FIG. 1 is a schematic cross-sectional view showing a washing machine, including a balancing member according to the invention.

FIG. 1 is a side cross-sectional view of a washing machine which has a balancing member according to the present invention. The washing machine is comprised of a housing 10 and an outer tub or a water container 20 housed in the housing by a suspension means (not shown). Further, a driving member 50 is provided under the outer tub 20. An inner tub 30, or a dehydrating basket having a plurality of holes 31, is rotatably mounted in the outer tub 20. Furthermore, at the inner-bottom of the inner tub 30, there is mounted a pulsator 40 which is rotatable by the driving member 50. Moreover, a balancing member 60 is attached to the circumference of an opening 30A of the inner tub 30 by a proper method (e.g. snap-in fitting or screw fastening), which is illustrated later.

Figure 2:
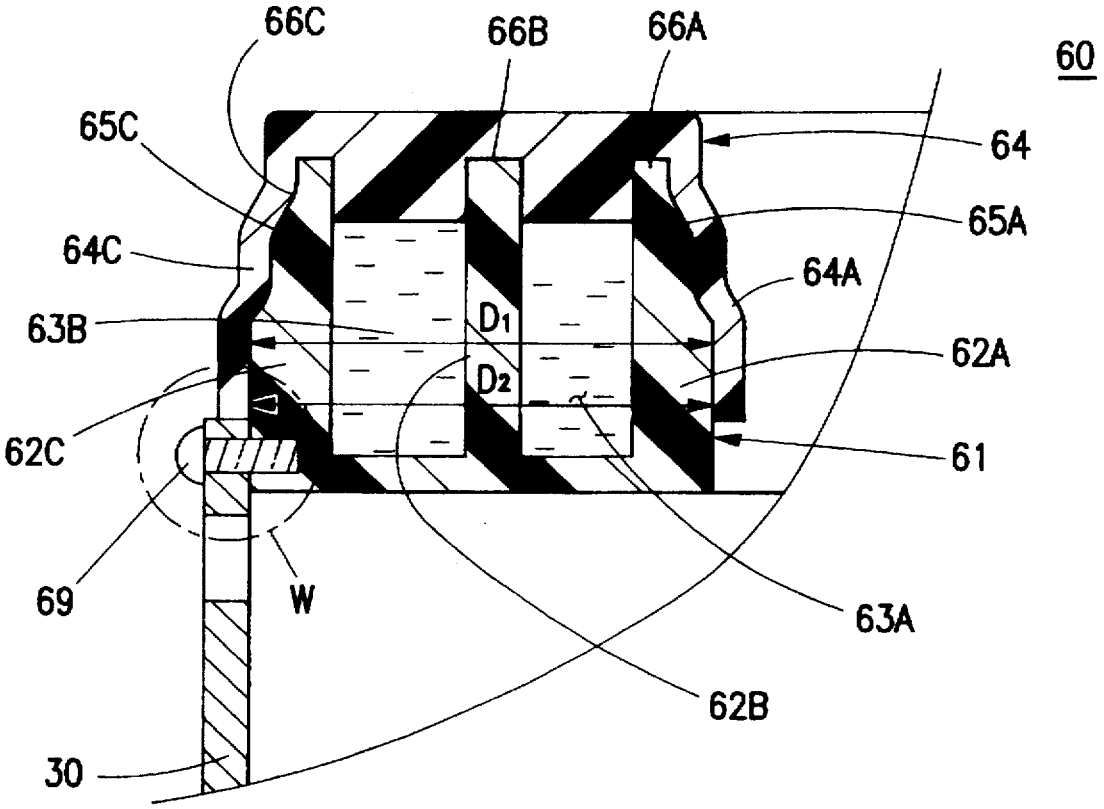
FIG. 2 is an enlarged cross-sectional view showing portion "X" of FIG. 1.
Figure 3:
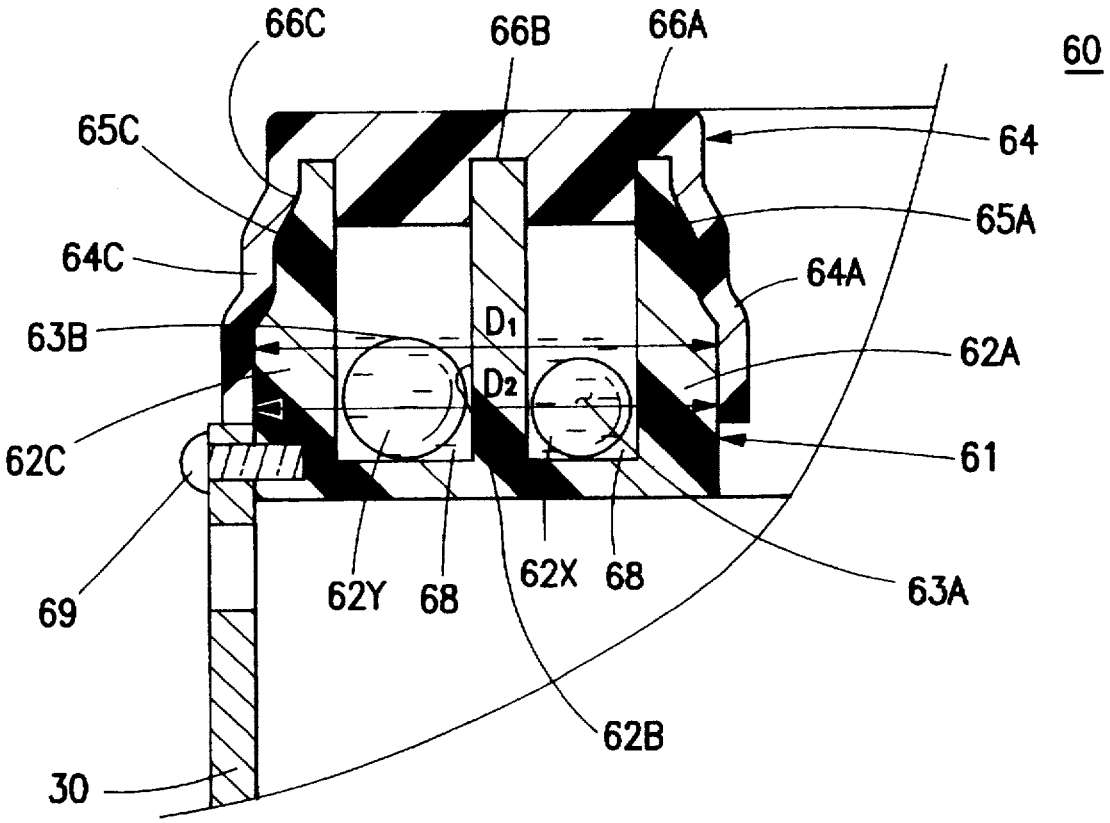
FIG. 3 is an enlarged cross-sectional view showing another embodiment of FIG. 2.

FIGS. 2 through 4 show various balancing members according to this invention. In FIG. 2, the balancing member 60 is comprised of an upper member 64 and a lower member 61. In the balancing member 60 are formed a plurality of passages 63A,63B which are coaxially arranged relative to the vertical shaft S—S. The lower member 61 is comprised of a relatively stiff material, and in this embodiment ABS resin is employed. A second partition 62B is located between the passages 63A,63B, and a first partition 62A is formed at the passage 63A adjacent to the vertical shaft S—S. A third partition 62C is formed at the passage 63B adjacent to the inner tub 30. At respective upper portions of the first partition 62A and the third partition 62C are formed stair type protrusions 65A,65C for solidly fitting with the upper member 64. The upper member 64 is made of polypropylene for exhibiting elasticity when fitting with the lower member 61. The upper member 64 has a groove 66B at the inner central portion of the upper member 64. The groove 66B receives a free end of the second partition 62B of the lower member 61 so that liquid in each passage 63A,63B can not leak. Additionally, another groove 66A is formed adjacent to the inner circumference of the upper member 64, while another groove 66C is formed adjacent to the outer circumference of the upper member 64.

Elastic skirts 64A,64C of the upper member 64 surround the first partition 62A and the third partition 62C of the lower member 61, respectively, and extend downwardly. The grooves 66A,66C formed inside the skirts 64A,64C have complimentary shapes respective to the protrusions 65A, 65C of the lower member 61.

In the lower member 61, prior to be jointed to the upper member, the distance between the outer wall, adjacent to the vertical shaft S—S, of the first partition 62A and the outer wall, adjacent to the inner circumference of the inner tub 30, of the third partition 62C is defined as $D_1$. Also, the distance between the inside walls of the skirts 64A,64C of the upper member 64 is defined as $D_2$. In this embodiment, the distance $D_1$ is slightly larger than the distance D2. Thus, when the upper member 64 is put on the lower member 61, the skirts 64A,64C of the upper member 64 are elastically fitted with the partitions 62A,62C of the lower member 61.

The aforementioned liquid occupies the passages 63A, 63B. A much larger quantity of liquid is poured into the second passage 63B than into the first passage 63A. The liquid volume difference between the first passage and second passage results in a larger concentric force in the second passage when the balancing member 60 rotates around the vertical shaft S—S.

The balancing member 60 is fitted inside the upper circumference of the inner tub 30 using the lower outer circumference of the third partition 62C of the balancing member 60. The inner tub 30 and the balancing member 60 are joined by a screw 69.

Hereafter, the same numbers are referenced to the same elements, the detailed explanation of which is omitted for the purpose of avoiding the repetition of the explanation.

FIG. 3 shows another embodiment wherein steel, or stainless steel balls 62X,62Y are arranged in the passages. To reduce friction generated from the contact of balls during their movement, high viscosity oil 68 occupies each passage. Silicon oil, PAG and mineral oil are employed as the oil. If the same volume of oil is contained in the passages, the centrifugal force generated by the rotation of the inner tub is maximally utilized under the condition that the balls are of a different size and weight.

Figure 4A:
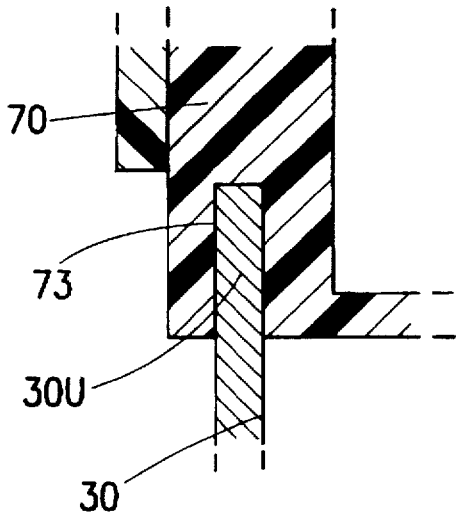
FIG. 4A is an enlarged cross-sectional view showing portion "W" of FIG. 2.
Figure 4B:
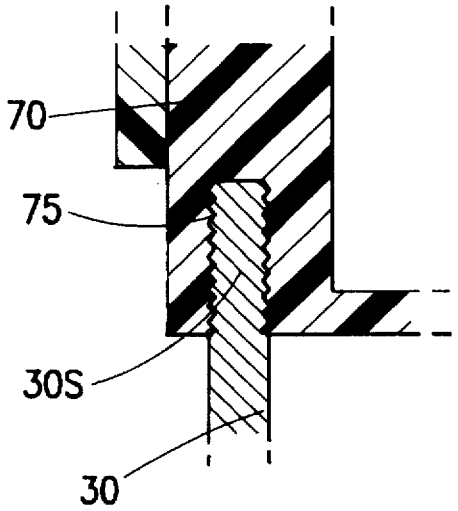
FIG. 4B is an enlarged cross-sectional view showing another embodiment of FIG. 4A.

That is, the size and weight of balls 62X housed in the passage 63A adjacent to the vertical shaft S—S are made to be smaller than balls 62Y. Thus, centrifugal force generated from rotation of the balancing member is efficiently utilized. FIGS. 4A and 4B are enlarged views of respective embodiments of portion "W" of FIG. 2. As shown in FIG. 4A, in the outermost partition of the lower member, there is formed a groove 73 for fitting with the upper end 30U of the inner tub 30. When the balancing member 60 is replaced, the balancing member 60 is easily disassembled from the inner tub 30. Furthermore, as shown in FIG. 4B, a male thread portion 30S is provided on the upper end of the inner tub 30, while a groove configured as a female thread portion 75 is provided in the outermost partition 70 of the lower member. This also results in an easy disassembly of the balancing member.

Figure 5:
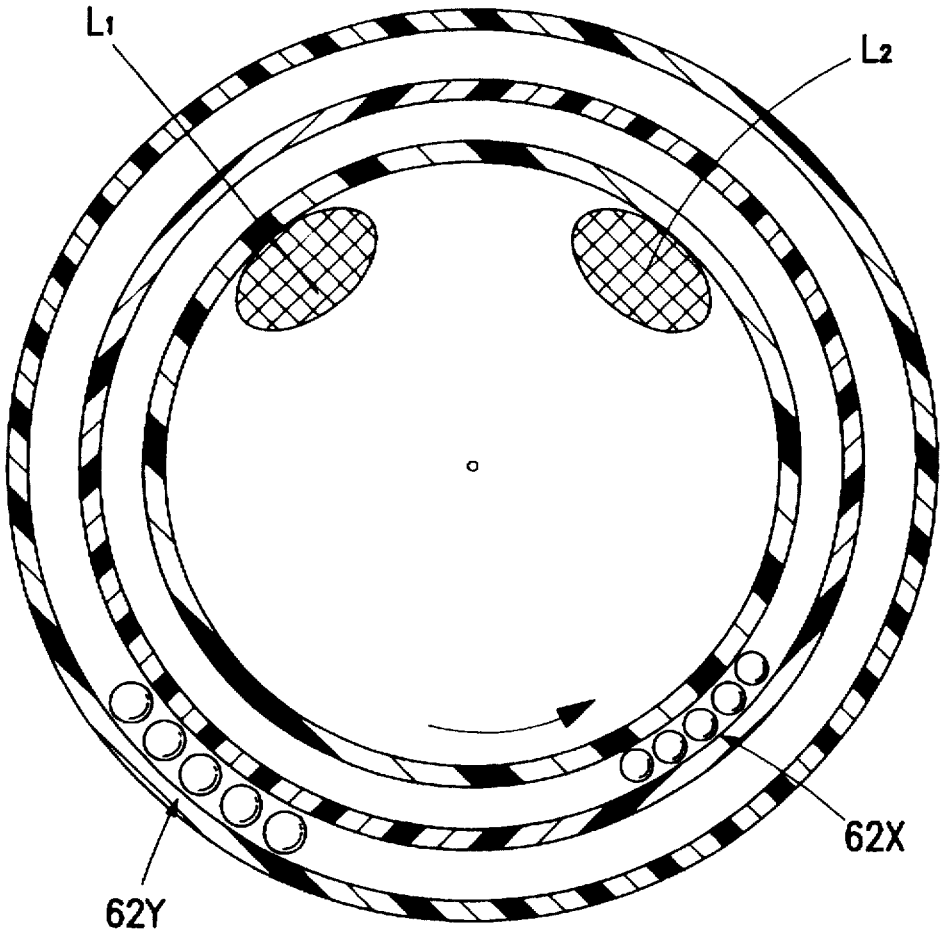
FIG. 5 is a cross-sectional view illustrating the operation of a balancing member.
Figure 6:
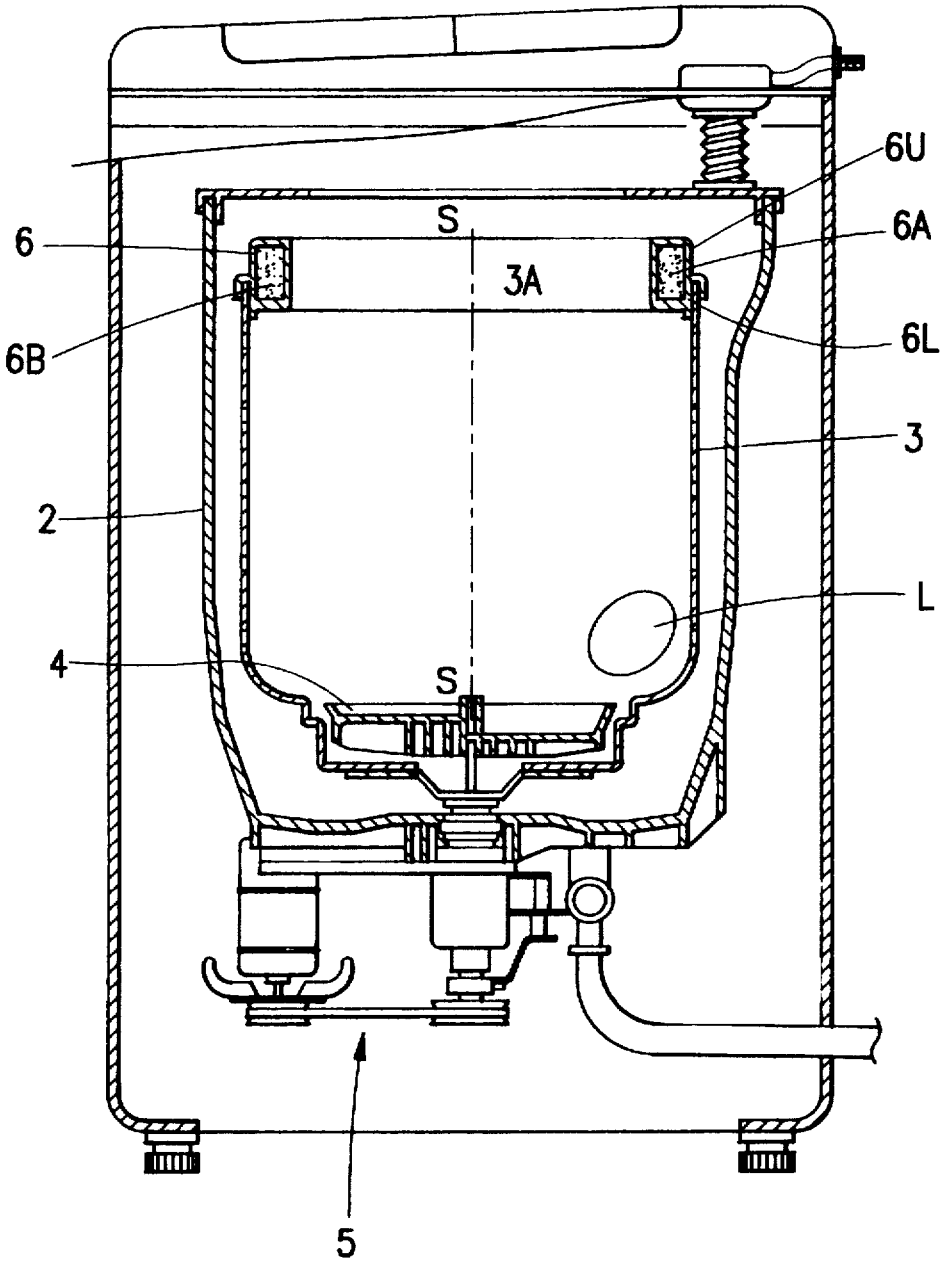
Fig. 6 (Prior Art)
FIG. 6 is a schematic cross-sectional view showing a washing machine of a prior art.

The washing machine with this balancing member is operated as follows: The inner tub 30 as well as the pulsator 40, are rotated at a high speed by the operation of the driving member 50. Simultaneously, the balancing member 60 is rotated, and liquid or balls housed in each passage are moved. As shown in FIG. 5, if laundry L1,L2 in the inner tub 30 is concentrated in a respective area, liquid or balls in each passage become situated opposite to the laundry L1,L2. The volume of liquid, or the size and weight of balls, counterbalances the weight of each load of laundry. Even if liquid, or oil for absorbing shock between the balls, is moved at a high speed, the lower member of the balancing member solidly fits with the upper member, thereby eliminating any gap between the upper member and the lower member.

Therefore, reliability of the liquid seal between the upper member and the lower member can be assured since the upper member is absolutely fitted with the lower member in an elastic or sealing manner.

Furthermore, since oil cannot be leaked outside the balancing members the balancing member can function a long time without losing its effectiveness.

Furthermore, replacement of the balancing member can be easily achieved since the balancing member can be promptly assembled into the inner tub or disassembled from the inner tub.

What is claimed is:

1. A washing machine comprising:

a housing;

an outer tub suspended in said housing;

an inner tub movably mounted on a vertical axis in said housing; and a balancing member mounted on said inner tub and arranged coaxially to said inner tub;

said balancing member comprising a lower member and an upper member covering said lower member;

said balancing member forming a plurality of coaxial annular passages in which a movable balancing medium is disposed;

said lower member of said balancing number provided with a downwardly open groove configured as a female screw thread, and an upper end of said inner tub being configured as a male screw thread enabling said balancing member to be mounted on said inner tub in response to relative rotation between said balancing member and said inner tub.

2. The washing machine as claimed in claim 1 wherein a first distance between an inner circumferential wall and an outer circumferential wall of said lower member is slightly larger than a second distance between walls of said upper member which contact said inner and outer circumferential walls prior to a joining of said upper and lower members, to create a tight fit therebetween.

3. The washing machine as claimed in claim 1 wherein said upper member elastically engages said lower member.

4. The washing machine as claimed in claim 1 wherein the balancing medium is a liquid.

5. The washing machine as claimed in claim 4 wherein the balancing medium further includes balls.

* * * * *